United States Patent [19]

Yanabu et al.

[11] Patent Number: 5,045,652

[45] Date of Patent: Sep. 3, 1991

[54] DISCONNECTOR OF GAS INSULATED SWITCHGEAR

[75] Inventors: Satoru Yanabu, Machida; Susumu Nishiwaki, Yokohama; Masayuki Ishikawa, Kawasaki; Hirokuni Aoyagi, Yokohama, all of Japan

[73] Assignee: Kabushiki Kaisha Toshiba, Kawasaki, Japan

[21] Appl. No.: 361,032

[22] Filed: Jun. 2, 1989

[30] Foreign Application Priority Data

Jun. 2, 1988 [JP] Japan ..... 63-134494

[51] Int. Cl.[5] ..... H01H 33/24; H01H 31/32

[52] U.S. Cl. ..... 200/148 R; 200/144 AP; 200/148 B

[58] Field of Search ..... 200/148 R, 148 B, 144 R, 200/144 AP

[56] References Cited

U.S. PATENT DOCUMENTS

| | | | |
|---|---|---|---|
| 2,978,560 | 4/1961 | Bates et al. | 200/148 R |
| 4,403,125 | 9/1983 | Yamaoka et al. | 200/148 R |
| 4,500,762 | 2/1985 | Yoshizumi | 200/148 R |
| 4,748,303 | 5/1988 | Kieffer | 200/148 R |

FOREIGN PATENT DOCUMENTS

| | | |
|---|---|---|
| 744144 | 5/1943 | Fed. Rep. of Germany . |
| 1137102 | 10/1967 | Fed. Rep. of Germany . |
| 53-38031 | 10/1978 | Japan . |
| 58-153332 | 4/1983 | Japan . |
| 60-42570 | 9/1985 | Japan . |
| 1014013 | 12/1965 | United Kingdom . |

*Primary Examiner*—J. R. Scott

*Attorney, Agent, or Firm*—Foley & Lardner

[57] ABSTRACT

A disconnector for a gas insulated switchgear in which the disconnector includes, in a metallic container filled with an insulated gas, a stationary electrode having a contact, a stationary electrode shield electrically connected to the stationary electrode to surround the contact, the stationary electrode shield made of an electrically resistant material and having a free end portion and inner and outer surfaces, and a movable electrode arranged to face the contact and being movable into and out of electrical contact with the contact, and in which the stationary electrode shield is arranged to flow discharging current therethrough due to an interelectrode voltage applied between the stationary electrode and the movable electrode. The disconnector includes an annular metallic electrode coaxially mounted on the free end portion of the stationary electrode shield so as to allow the movable electrode to pass therethrough. The metallic electrode has an exposed surface exposed to the insulated gas and the exposed surface of the metallic electrode is adapted to be larger in field strength than the inner and outer surfaces of the stationary electrode shield for producing the discharge between the exposed surface of the metallic electrode and the movable electrode.

6 Claims, 12 Drawing Sheets

DISCONNECTOR OF GAS INSULATED SWITCHGEAR

BACKGROUND OF THE INVENTION

1. Field of the Invention

The present invention relates to a disconnector for a gas insulated switchgear or a gas insulated substation.

2. Prior Art

A disconnector is used in disconnecting equipment from the electric power source for maintenance, changing connections, and opening and closing circuits, and is supplied in various types for low voltage to an ultra high voltage.

FIG. 6 illustrates a typical example of the disconnector according to the prior art, in which an insulating gas, such as $SF_6$, is sealed in the metallic container or tank 1. Conductors 4 and 5 are electrically connected to a stationary electrode terminal and a movable electrode terminal of the disconnector, respectively. These conductors 4 and 5 are secured to the metallic container 1 by means of respective insulating spacers 3, 3.

The conductor 4 of the stationary electrode terminal is provided with a stationary electrode 6, to which are mounted a stationary electrode contact 10 and a resistor 8. An annular stationary electrode metallic shield 7 is mounted to the stationary electrode 6 through a resistor 8, for surrounding the stationary electrode contact 10.

The conductor 5 of the movable electrode terminal has a movable electrode contact 11 electrically connected to it. A movable electrode 9 which is driven by an insulating rod 13 is arranged to pass through the inside of the movable electrode contact 11. A movable electrode metallic shield 12 is mounted to the conductor 5 to surround the movable electrode contact 11. The insulating rod 13 is connected to an actuator (not shown) for accomplishing opening and closing of the disconnector.

In such a disconnector, it is generally required to cut off charging current in a shorted line.

When the distributed capacitance and inductance of each line, transformer, etc. are expressed as a lumped capacitance and inductance, an equivalent circuit of a charging current breaking circuit of the line may be expressed as in FIG. 7, in which reference numeral 14 designates a source voltage, 15 is the short-circuit impedance, 16 is the power source equipment capacitance, 17 is the inductance of the power source line, 18 is the capacitance of the load line, 19 is the inductance of the load line and 20 is the disconnector. The insulation recovery characteristic between the tip portion of the movable electrode 9 and the inner edge of the stationary electrode metallic shield 7 is shown in FIG. 8.

When the circuit in FIG. 7 is opened by the disconnecting switch 20 having such a characteristic, a voltage waveform shown in FIG. 9 is obtained. In FIG. 9, the solid line indicates a voltage waveform at a point a in FIG. 7, and the broken line indicates a voltage waveform of the power source. The difference between the solid line and the broken line is the interelectrode voltage or voltage across the electrodes of the disconnector 20.

This relation between the voltage waveforms is explained as follows. Suppose the opening between the movable electrode 9 and the stationary electrode contact 10 is made, for example, at a point A in FIG. 9. After the tip portion of the movable electrode 9 moves out of the stationary electrode metallic shield 7, current is cut off at a point B, so that the source voltage is maintained across the capacitor 18 of the load. Thus, the interelectrode voltage of the disconnector 20 becomes large as the source voltage varies. When the interelectrode is larger than the insulation restoring voltage, reignition occurs at a point C. The arc current is small at this moment and hence current is cut off at once with the source voltage at this moment remaining across the load capacitance 18. The restrike interelectrode voltage becomes large as the insulation restoring voltage raises with restrikes repeated. When the insulation restoring voltage becomes larger than the interelectrode voltage, restrike is stopped and cut off is accomplished. The restrike points C, D, E, F, G and H in FIG. 9 correspond to distances between the electrodes. The restrikes occur between the inner edge of the stationary electrode metallic shield 7 and the tip of the movable electrode 9 and form a restrike arc 23 as shown in FIG. 10.

After the opening of the disconnector in such a manner, the movable electrode 9 is accommodated within the movable electrode metallic shield 12 and must withstand voltage between the stationary electrode shield 7 and the movable electrode shield 12, which serve to makes uniform the electric field to thereby increase the interelectrode withstand voltage.

When reignition occurs between the electrodes, that is, the movable electrode 9 and the stationary electrode metallic shield 7 of a disconnector, as in FIG. 6, which uses a resistor 8 made of a metallic material, high-frequency oscillation is generated in the circuit with capacitances 16, 18 and inductances 17, 19 in FIG. 7, thereby developing high-frequency overvoltages, as illustrated in FIG. 11. The larger the interelectrode voltage of the disconnector at restrike, the larger these high-frequency overvoltages become. There is a risk that high-frequency overvoltages will impair the insulation of the disconnector or adjacent equipment. For reducing overvoltage at restrike, the resistor 8 is provided as in FIG. 6, so that current, due to restrike at opening of the disconnector, flows through a path including the conductor 4, the stationary electrode 6, the resistor 8, the stationary electrode metallic shield 7, the movable electrode 9, the movable electrode contact 11 and conductor 5 for reducing high-frequency overvoltage by using a circuit loss in the resistor 8. Such a disconnector is disclosed, for example, in Japanese Patent (examined) Publications Nos. 53-38031 and 60-42570. When high-frequency voltage due to restrike is suppressed, high voltage is applied across the resistor 8 and hence the latter must be long enough to withstand such a voltage. This involves a problem that the disconnector cannot be small-sized, since the length L from the stationary electrode 6 to the inner edge of the stationary electrode metallic shield 7 cannot be sufficiently shortened.

To overcome this drawback, a disconnector, shown in FIG. 12, is proposed in Japanese Utility Model (unexamined) Laid-Open Publication No. 58-53332, herein. In this prior art disconnector, a stationary electrode 6 and a movable electrode 9 are opposingly arranged in a metallic container 1. The stationary electrode 6 has a stationary electrode contact 10, integrally formed on the central portion thereof, and a stationary electrode shield 25, mounted to it to surround the stationary electrode contact 10, the stationary electrode shield 25 being made of an electrical resistance material. The stationary electrode shield 25 is in the shape of a hollow cylinder, having an inwardly curled circumferential flange at its free end or distal end portion. The inwardly curled peripheral flange has an annular metallic electrode 26 mounted at its inner edge. A movable electrode metallic shield 12 is arranged to surround the movable electrode 9. In the disconnector with such a structure, the inwardly curled circumferential flange of the stationary electrode shield 25, which flange is arranged to face the movable electrode metallic shield 12, serves to unify the electric field between the shields 12, 25 when the opening of the disconnector is completed by placing the movable electrode 9 within the shield 12, and thereby the withstand voltage between the shields 12 and 25 is raised. When the movable electrode 9 is moved rightwards from the closed position, indicated by the dot-and-dash line in FIG. 12, discharge occurs between the movable electrode 9 and a metallic electrode 26, provided at the inner edge of the stationary electrode shield 25, to produce a discharge arc 27. At this moment, current flows from the movable electrode 9 to the stationary electrode 6 through the stationary electrode shield 25 which is a resistor. When the tip portion of the movable electrode 9 moves out of the stationary electrode shield 25, restrike occurs between the tip of the movable electrode 9 and the stationary electrode shield 25 to form a restrike arc 28 (FIG. 13). Also, in this case, current flows from the movable electrode 9 to the stationary electrode 6 through the stationary electrode shield 25. Thus, overvoltage is suppressed by flowing of the current or the restrike current through the shield or resistor 25 during opening of the disconnector, to produce a resistive loss.

When restrike is generated, voltage is applied across the portion of the stationary electrode shield 25, that is, a portion, having a length $l_1$ from a point, where the restrike occurs, to the proximal end of the shield 25. Voltage is also distributed across the inwardly curled flange of the stationary electrode shield 25, which is a resistor, and hence the axial length $l_2$ of the shield 25 may be shortened. Furthermore, the stationary electrode shield 7 of the disconnector in FIG. 6 is obviated and thus the length L from the stationary electrode 6 to the inner edge of the shield 7 may be considerably reduced. This enables the disconnector to be fairly small-sized.

The disconnector in FIGS. 12 and 13, however, has the disadvantages below. As shown in FIG. 14, current from the movable electrode 9 flows through the annular metallic electrode 26 via arc discharge 27 and then through the stationary electrode shield 25 along electric path P. The thickness of the stationary electrode shield 25 is constant. Thus, as the current flows from the inner edge to the proximal edge of the inwardly curled flange, the cross-sectional area of the current path P becomes larger; that is, in the inwardly curled flange, a section A< section B< section C< section D in area, the sections A, B, C and D being at predetermined intervals. The current which flows through the inwardly curled flange is constant at each section A. B, C, D and hence the larger the cross-sectional area of the current path P, the smaller the current density. Thus, the sections vary in current density, i.e. A>B>C>D. For this reason, voltage drop is the largest at the section A and decreases in the alphabetic order and hence voltage distribution to a portion, near the metallic electrode 26, of the stationary electrode shield 25 may become excessively large. This may cause the stationary electrode shield 25 to be damaged.

As shown in FIG. 15, restrike which is generated between the movable electrode 9 and the stationary electrode shield 25 occurs along a path between them along which path the field strength is the largest between them. That is, restrike arcs 28 are formed along the shortest path Q-R between the stationary electrode shield 25 and the movable electrode 9. The restrike current diverts in the stationary electrode shield 25 at the restrike generating point Q and then flows along the current path P. The current density of the stationary electrode shield 25 is hence the largest at the point Q and gradually decreases toward the proximal end of the inwardly curled flange. Thus, the voltage distribution in the stationary electrode shield 25 is not uniform and becomes excessively large near the restrike current flow-in point Q. This may result in breakdown of the stationary electrode shield 25.

Accordingly, it is an object of the present invention to provide a disconnector for a gas insulated switchgear, which disconnector provides fairly uniform voltage distribution to the stationary electrode shield, made of a resistant material, for enhancing withstand voltage and dielectric strength.

It is another object of the present invention to provide a disconnector for a gas insulated switchgear, in which the disconnector's stationary electrode shield is made fairly small as compared to that of the prior art, for down-sizing the overall disconnector.

SUMMARY OF THE INVENTION

With these and other objects in view the present invention provides a disconnector of a gas insulated switchgear in which the disconnector includes, in a metallic container filled with an insulated gas, a stationary electrode having a contact, a stationary electrode shield electrically connected to the stationary electrode to surround the contact, the stationary electrode shield made of an electrically resistant material and having a free end portion and inner and outer surfaces, and a movable electrode arranged to face the contact and being movable to come into to electrical contact with and move out of electrical contact with the contact, and in which the stationary electrode shield is arranged to flow discharging current therethrough due to an inter-electrode voltage applied between the stationary electrode and the movable electrode. The disconnector includes an annular metallic electrode coaxially mounted on the free end portion of the stationary electrode shield so as to allow the movable electrode to pass therethrough. The metallic electrode has an exposed surface exposed to the insulated gas and the exposed surface of the metallic electrode is adapted to be larger in field strength than the inner and outer surfaces of the stationary electrode shield for producing a discharge between the exposed surface of the metallic electrode and the movable electrode.

BRIEF DESCRIPTION OF THE DRAWINGS

The invention will now be described by way of example with reference to the accompanying drawings in which.

DETAILED DESCRIPTION OF THE PREFERRED EMBODIMENTS

Figure 1:
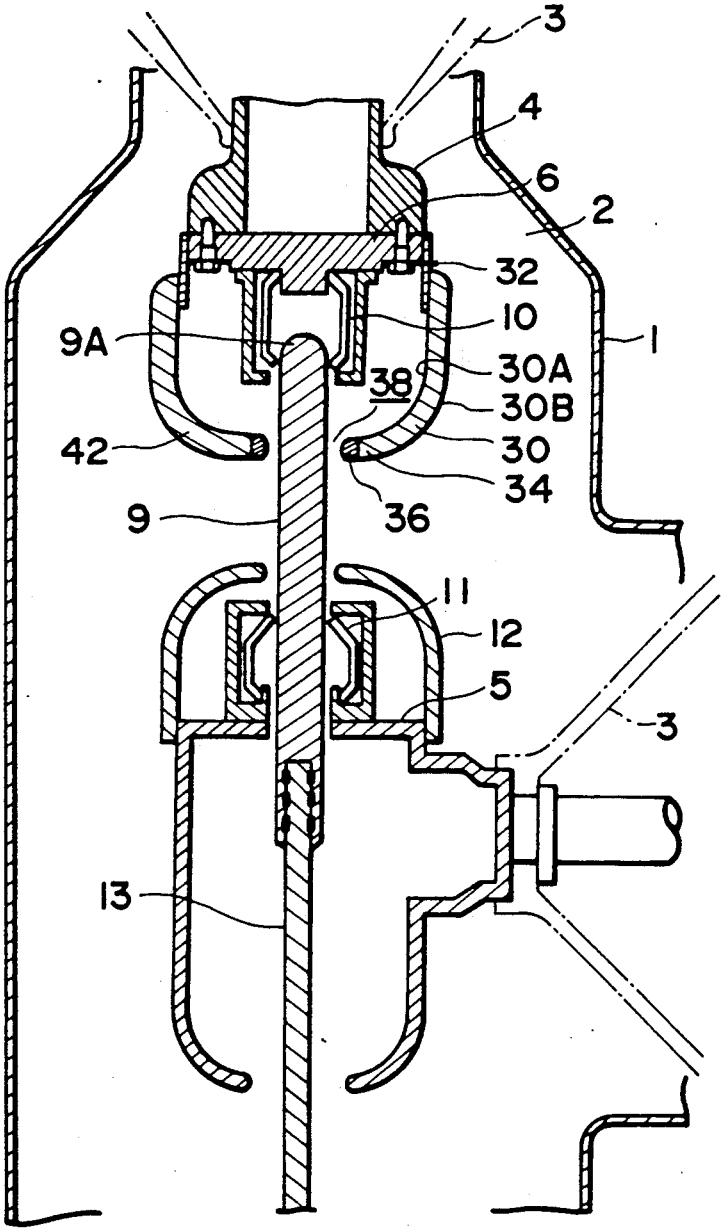
FIG. 1 is an axial sectional view of a disconnector according to the present invention.
Figure 2:
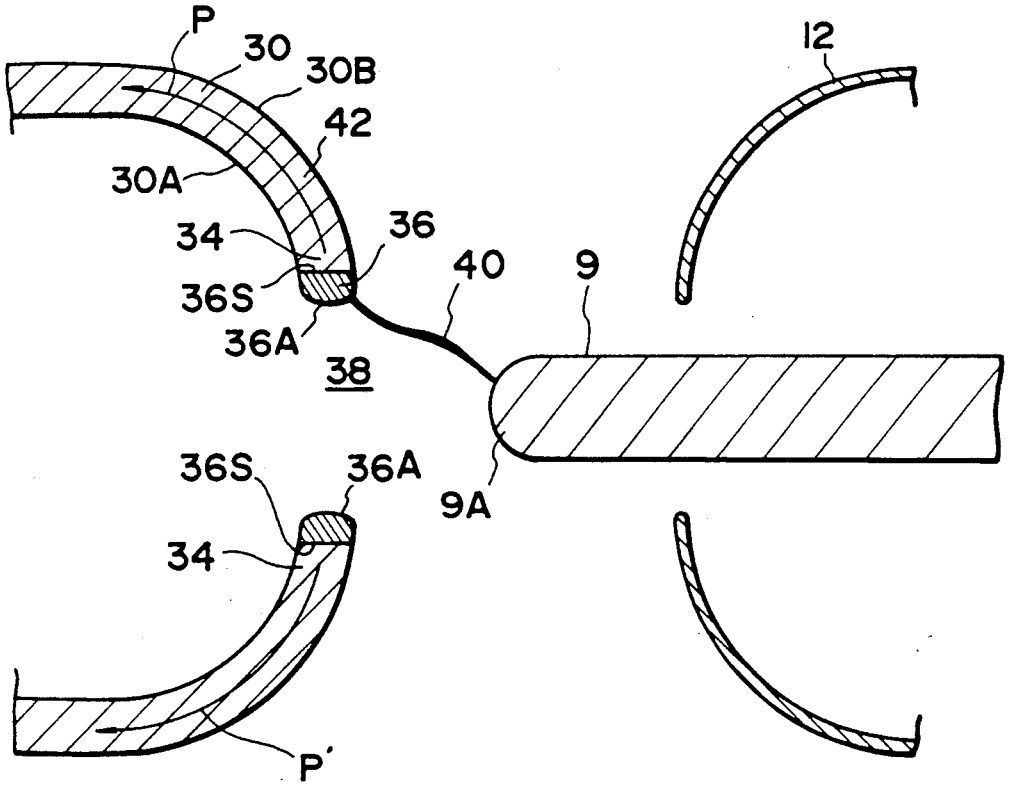
FIG. 2 is an enlarged axial sectional view of the disconnector in FIG. 1.

In FIGS. 1 and 2, parts corresponding to parts in FIGS. 6–15 are designated by like reference characters and descriptions thereof are omitted.

Also in this embodiment, a generally cup-shaped stationary electrode shield 30 which is made of a resistant material is coaxially mounted to the periphery of the stationary electrode 6 by means of a ring-shaped supporting member 32 for surrounding stationary electrode contact 10. The stationary electrode shield 30 has an inner edge 34, to which is mounted a ring-shaped metallic electrode 36 defining a center opening 38. The metallic electrode 36 is formed so that the field strength on an exposed surface 36A thereof is larger than the field strength on the inner and outer surfaces 30A and 30B of the stationary electrode shield 30 when the tip 9A of the movable electrode 9 is moved out of the stationary electrode shield 30 to apply voltage across the electrodes. With such a construction, the disconnector is capable of unifying potential distribution in the stationary electrode shield 30, when restrike occurs, in a manner described below. When the tip 9A of the movable electrode 9 moves out of the stationary electrode 6 in opening of the disconnector, interelectrode voltage is applied between the metallic electrode 36 and the tip 9A of the movable electrode 9. In this event, the exposed surface 36A of the metallic electrode 36 is larger in field strength than surfaces of the stationary electrode shield 30, and hence restrike is produced on an exposed surface 36A of the metallic electrode 36 to form a restrike arc 40, the exposed surface being exposed to the insulating gas. The restrike current due to the restrike arc 30 flows into the stationary electrode shield 30 through the whole outer circumferential surface 36S of the metallic electrode 36. Thus, in this embodiment, the current density near the restrike current inflow portion of the shield 30 is fairly smaller and more unified than in the disconnector of the prior art in which the restrike current flows directly into the stationary electrode shield 30 through a spot on it, the restrike arc is formed at the spot.

Figure 3:
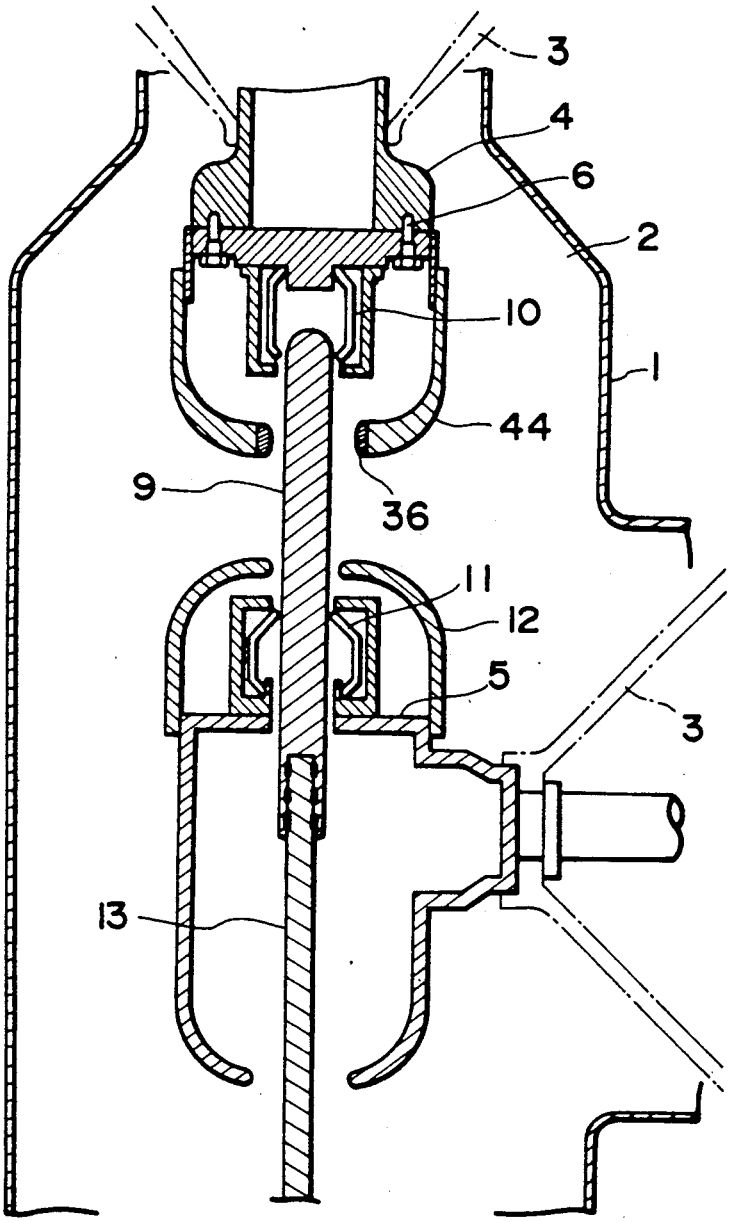
FIG. 3 is an axial sectional view of a modified form of the disconnector of FIG. 1.
Figure 4:
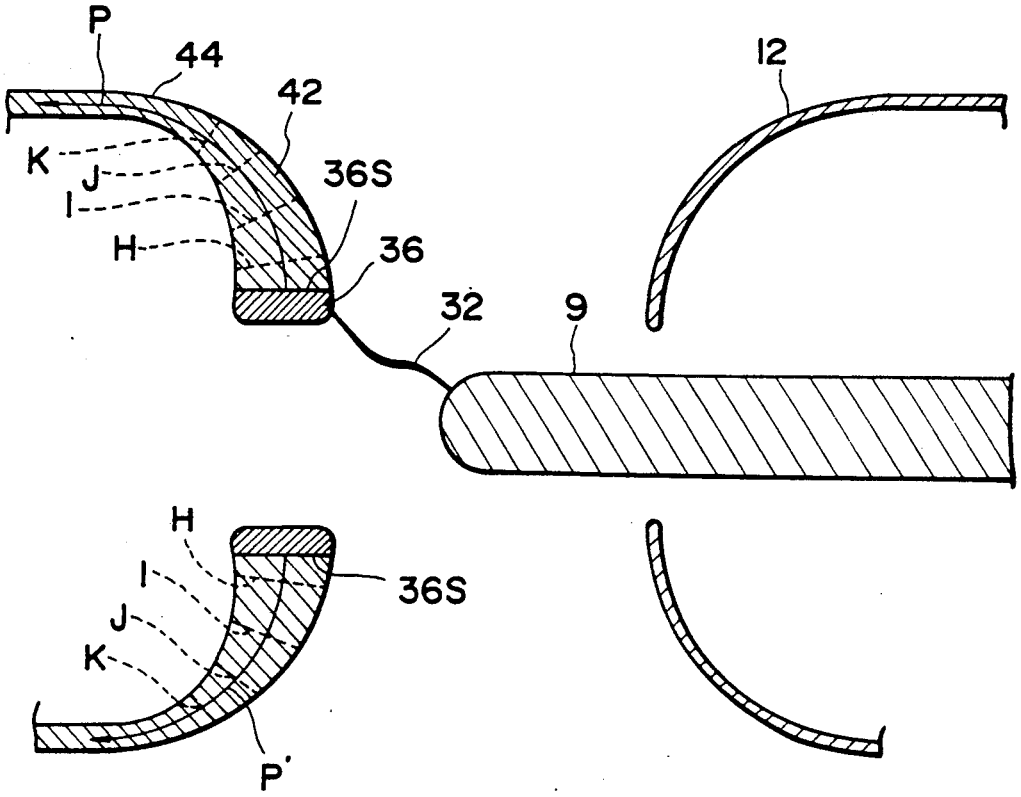
FIG. 4 is an enlarged axial sectional view of the modified disconnector in FIG. 3.

The thickness of the inwardly curved flange 42 of the stationary electrode shield 44 may be gradually increased toward the metallic electrode 36 as shown in FIGS. 3 and 4. The thickness of the inwardly curved flange 44 varies so that sections H, J, K and L, taken perpendicularly to the current path P at predetermined distances from the outer circumferential face 36A of the metallic electrode 36, are substantially equal in area as illustrated in FIG. 4. In addition to the advantage of the preceding embodiment, this modified disconnector provides substantially equal current density of the restrike current in every section of the stationary electrode shield 44.

Figure 5:
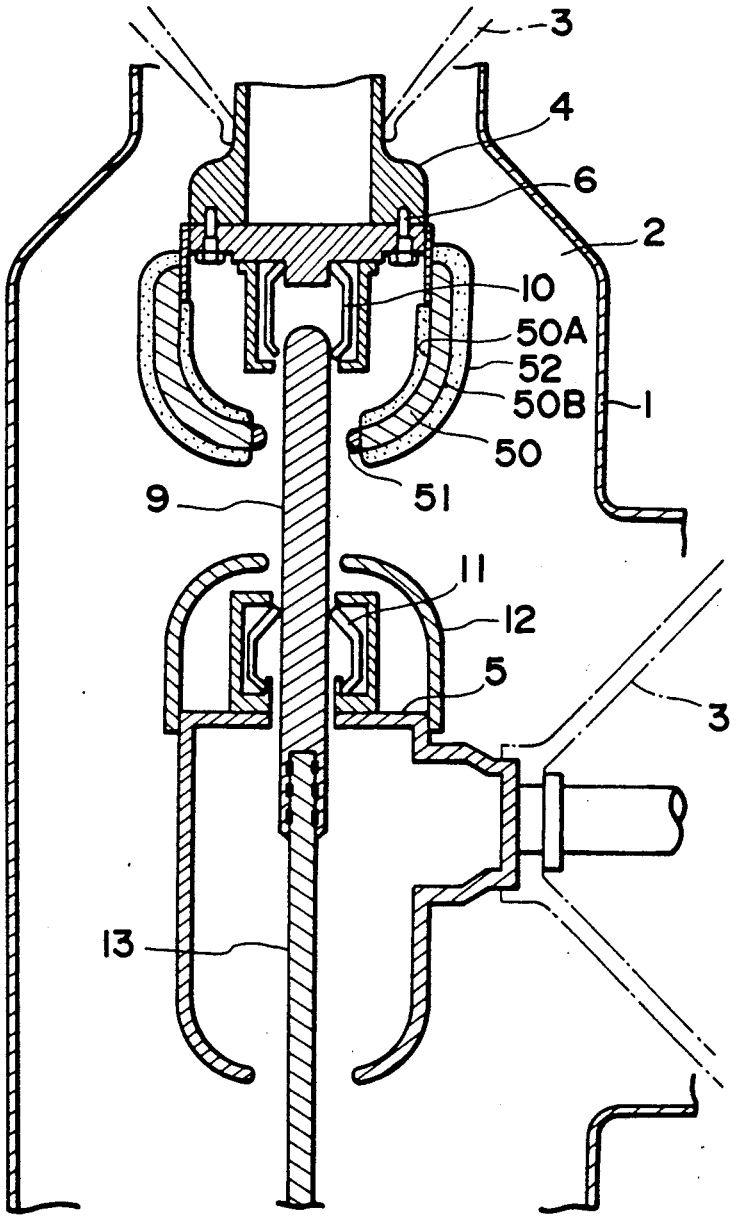
FIG. 5 is an axial sectional view of another modified form of the disconnector in FIG. 1.
Figure 6:
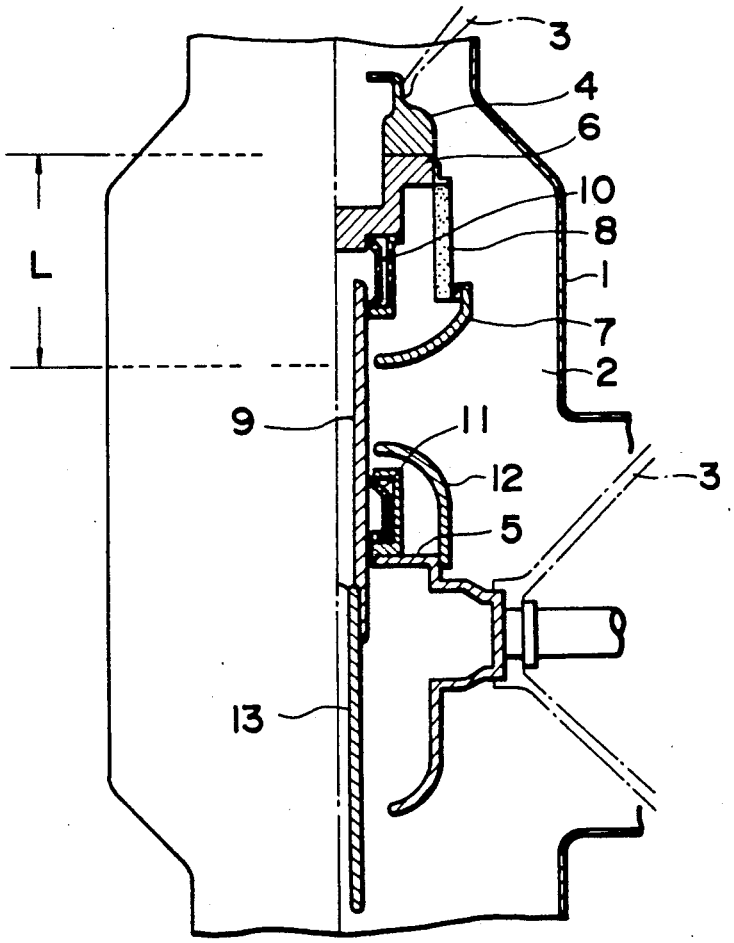
FIG. 6 PRIOR ART
FIG. 6 illustrates a partial axial section of the disconnector of the prior art.
Figure 7:
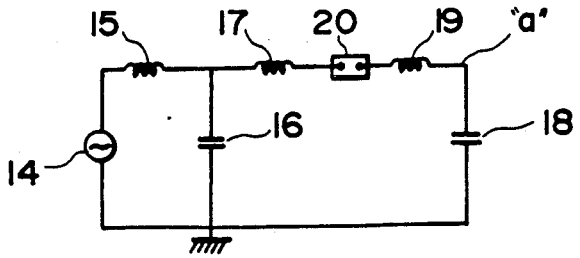
FIG. 7 PRIOR ART
FIG. 7 shows an equivalent circuit of the charging current breaking circuit using the disconnector in FIG. 6.
Figure 8:
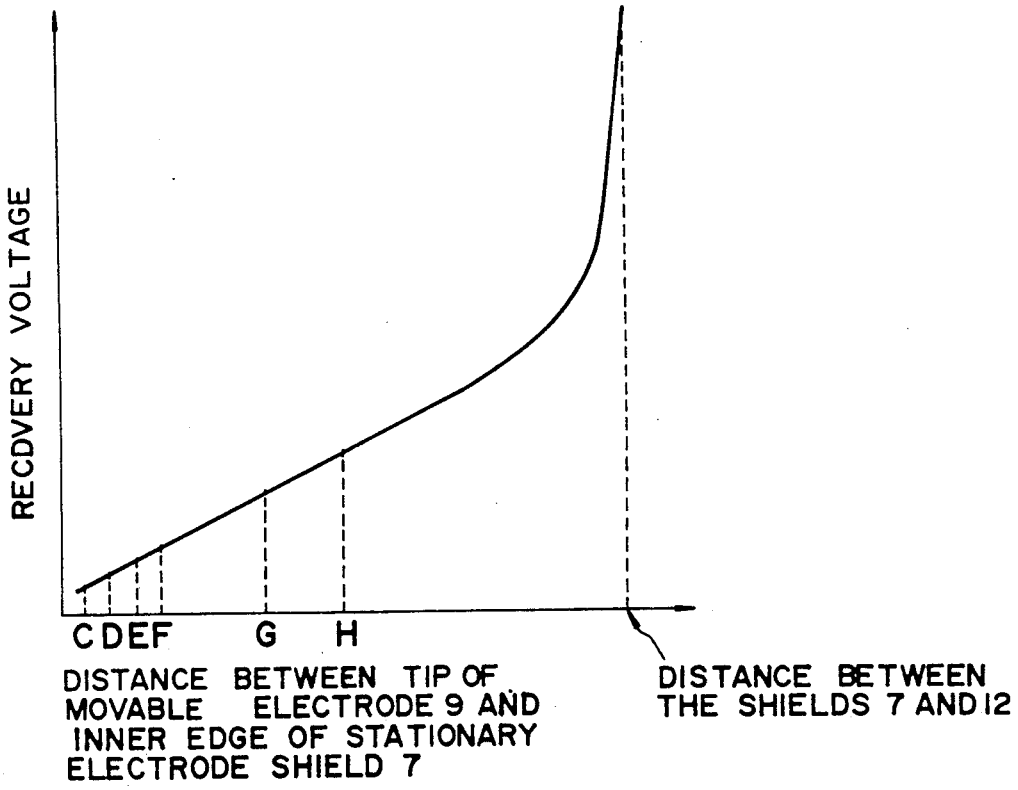
FIG. 8 PRIOR ART
FIG. 8 is a graph illustrating the insulation recovery characteristic of the electrodes of the disconnector of FIG. 6.
Figure 9:
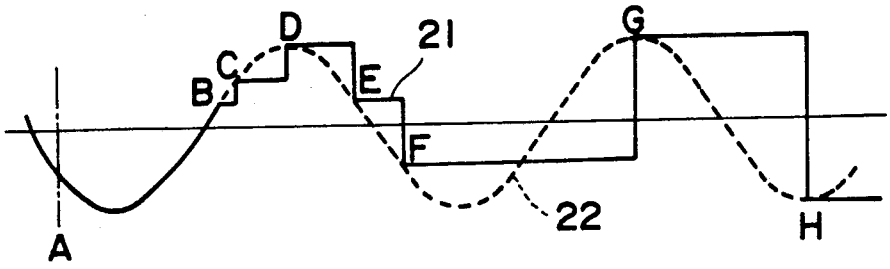
FIG. 9 PRIOR ART
FIG. 9 shows voltage waveforms due to restrikes at breaking of charging current by the disconnector in FIG. 6.
Figure 10:
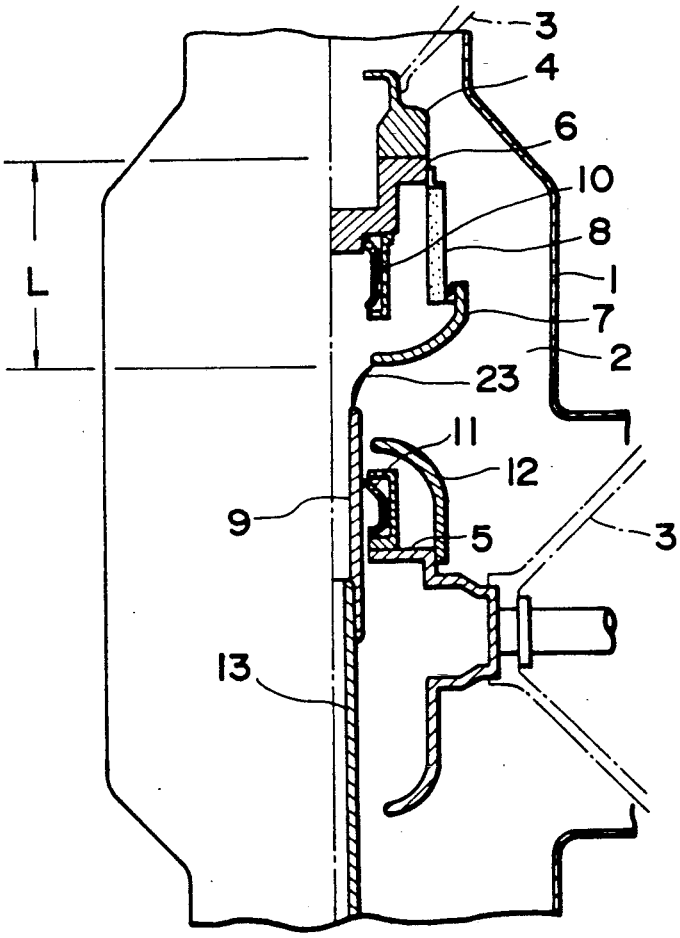
FIG. 10 PRIOR ART
FIG. 10 is a partial axial sectional view of the disconnector of FIG. 6.
Figure 11:
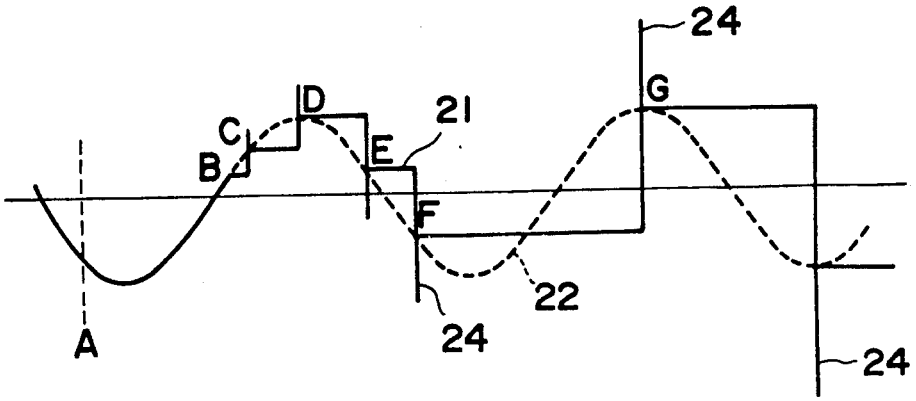
FIG. 11 PRIOR ART
FIG. 11 shows restrike serge voltage in the disconnector in FIG. 6.
Figure 12:
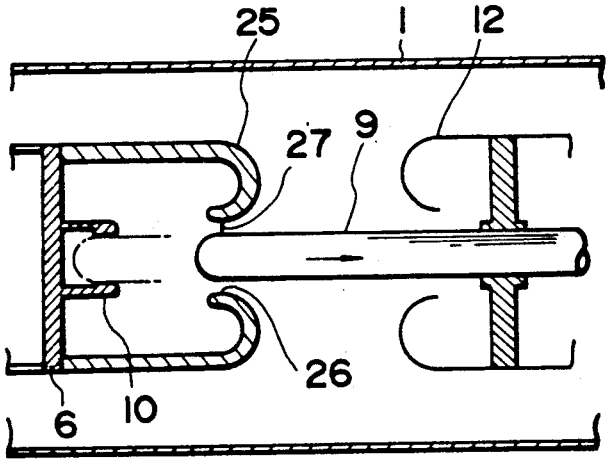
FIG. 12 PRIOR ART
FIG. 12 is a diagrammatic axial sectional view of another disconnector of the prior art.
Figure 13:
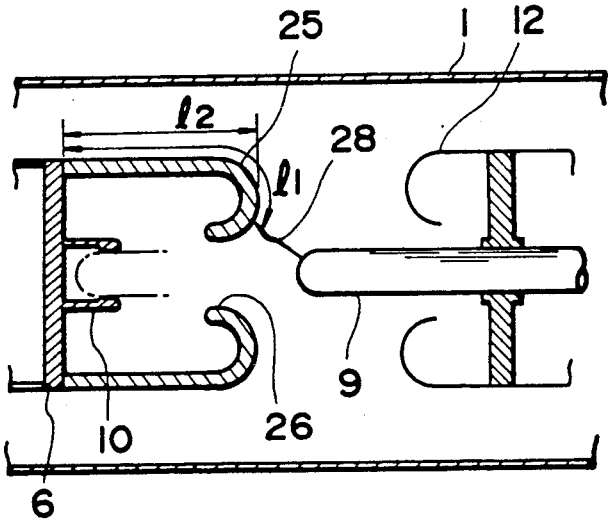
FIG. 13 PRIOR ART
FIG. 13 is a diagrammatic axial sectional view of the disconnector in FIG. 12 when restrike occurs.
Figure 14:
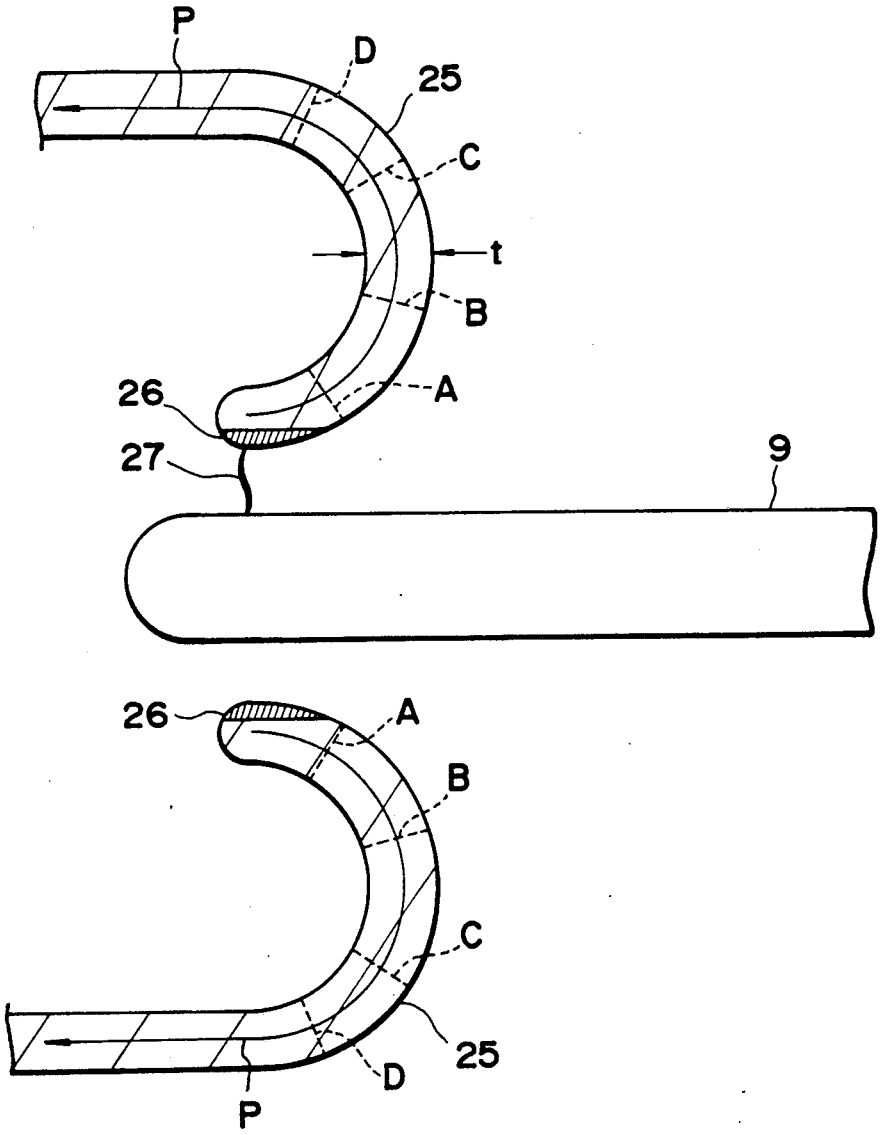
FIG. 14 PRIOR ART
FIG. 14 shows an enlarged partial axial section of the disconnector in FIG. 12 with restrike generated.
Figure 15:
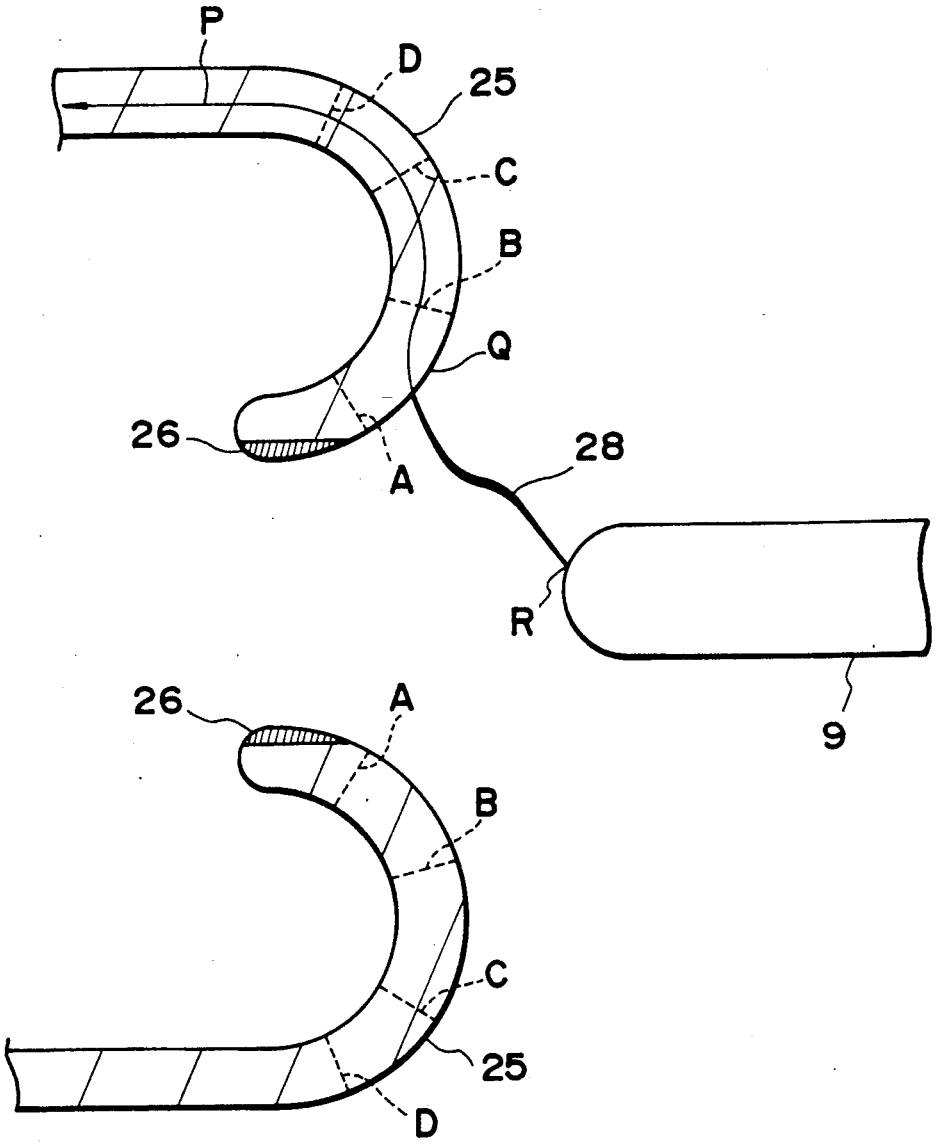
FIG. 15 PRIOR ART
FIG. 15 shows an enlarged partial axial section of the disconnector in FIG. 13.

As shown in FIG. 5, the inner and outer surfaces 50A and 50B of the stationary electrode shield 50 may be coated with a conventional insulating material for reinforcement to enhance its strength.

What is claimed is:

1. A disconnector for gas insulated switchgear, comprising:

a metallic container filled with an insulating gas, a stationary electrode having a contact, a stationary electrode shield electrically connected to the stationary electrode to surround the contact, the stationary electrode shield being made of an electrically resistant material and having a free end portion and inner and outer surfaces;

a movable electrode arranged to face the contact and be movable into an electrical contact with and out of electrical contact with the contact, and in which the stationary electrode shield is arranged to flow discharge current therethrough due to an interelectrode voltage applied between the stationary electrode and the movable electrode and;

an annular metallic electrode coaxially mounted on the free end portion of the stationary electrode shield so as to allow the movable electrode to pass therethrough, the metallic electrode having an exposed surface exposed to the insulating gas, the exposed surface of the metallic electrode being larger in field strength than the inner and outer surfaces of the stationary electrode shield for producing a discharge between the exposed surface of the metallic electrode and the movable electrode.

2. A disconnector as recited in claim 1, wherein the metallic electrode includes an outer circumferential surface mounted to the free end portion of the stationary electrode shield, whereby the discharge current flows through the outer circumferential surface of the metallic electrode into the stationary electrode shield.

3. A disconnector as recited in claim 2, wherein the free end of the stationary electrode shield is curved inwards to have an inner edge, the metallic electrode being mounted to the inner edge of the stationary electrode shield.

4. A disconnector as recited in claim 3, wherein the stationary electrode shield comprises an insulation coating formed on the inner and outer surfaces thereof for enhancing strength thereof.

5. A disconnector as recited in claim 3, wherein the stationary electrode shield is formed to increase in thickness toward the inner edge thereof for unifying the discharge current in current density flowing therethrough.

6. A disconnector as recited in claim 5, wherein the stationary electrode shield comprises an insulation coating formed on the inner and outer surfaces thereof for enhancing the strength thereof.

* * * * *